US006506992B2

(12) United States Patent
Kim

(10) Patent No.: US 6,506,992 B2
(45) Date of Patent: Jan. 14, 2003

(54) VACUUM INTERRUPTER FOR VACUUM BREAKER

(75) Inventor: Sung IL Kim, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/976,027

(22) Filed: Oct. 15, 2001

(65) Prior Publication Data

US 2002/0043514 A1 Apr. 18, 2002

(30) Foreign Application Priority Data

Oct. 16, 2000 (KR) ..... 2000-60742

(51) Int. Cl.[7] ..... H01H 33/66
(52) U.S. Cl. ..... 218/123; 218/128
(58) Field of Search ..... 218/123, 127, 218/128, 118–140, 146, 129

(56) References Cited

U.S. PATENT DOCUMENTS 6,163,002 A * 12/2000 Ahn et al. ..... 218/123
6,248,969 B1 * 6/2001 Komuro et al. ..... 218/118

FOREIGN PATENT DOCUMENTS

| | | | |
|---|---|---|---|
| DE | 19933495 | * | 7/1998 |
| JP | 11167847 | * | 6/1999 |

* cited by examiner

*Primary Examiner*—Lincoln Donovan
*Assistant Examiner*—M. Fishman
(74) *Attorney, Agent, or Firm*—Birch, Stewart, Kolasch & Birch, LLP

(57) ABSTRACT

A vacuum interrupter for a vacuum breaker, by which melting on contact surface caused by are concentration when a large current is broken and the arc can be rapidly extinguished by forming a strong magnetic field in vertical direction same as the arc when electrodes are separated, comprises: a vacuum container; a stationary cylinder electrode fixed on upper part of the vacuum container so as to be sealed; a movable cylinder electrode disposed on lower part of the vacuum container so as to be moved in vertical direction; and a stationary contact assembly and a movable contact assembly respectively connected to the stationary cylinder electrode and to the movable cylinder electrode for inducing electric current to be rotated to one direction and forming a compounded vertical magnetic field.

6 Claims, 8 Drawing Sheets

VACUUM INTERRUPTER FOR VACUUM BREAKER

BACKGROUND OF THE INVENTION

1. Field of the Invention

The present invention relates to a circuit breaker, and particularly, to a vacuum interrupter for a vacuum breaker which can improve circuit breaking function by making an electrode structure as a vertical magnetic field method.

2. Description of the Background Art

Generally, a circuit breaker is a electric protecting apparatus which is installed between an electric source and load units in order to protect a load unit and a load line such as a motor, and a transformer from an abnormal current(a large-current caused by accidents such as short circuit and a grounding fault) generated on an electric circuit such as a transmission/distribution line and a transforming device for private, to opening/closing load circuits, and to perform distribution function for changing the electric power line to another line.

In addition, the circuit breaker can be classified into an oil circuit breaker using oil, a gas circuit breaker using SF6 gas which is inert gas, an air circuit breaker using the air, a magnetic blow-out circuit breaker using magnetism, and a vacuum breaker using vacuum in accordance with used arc extinguishing medium.

Herein, the vacuum breaker has higher insulating strength in a vacuum state of $10^{-3}$ torr, and therefore it is used most frequently among middle voltage circuit breakers. In addition, developments for high voltage, large current, and for small size are proceeded.

A vacuum interrupter which is a major constitutional component of the vacuum circuit breaker is provided to break the electric current by separating a movable electrode and a stationary electrode, if a mechanical actuator is operated by an electric signal of the abnormal current which is detected in a controlling circuit when the abnormal current generated.

The vacuum interrupter for breaking large current can be classified into a horizontal magnetic field type and a vertical magnetic field type. In case of the horizontal magnetic field type vacuum interrupter, an arc is extinguished while moving an arc magnetic field generated horizontally in accordance with the arc which is generated naturally in vertical direction when the contacts are separated. However, in this vacuum interrupter of horizontal magnetic field, the arc is concentrated on one point on the contacts when large current of higher than 40KA is generated, and therefore the contacts may be melted by the concentrated arc. In addition, a fusion line is formed on the contacts along with the moving path of the concentrated arc.

Therefore, in order to solve the problems of the vacuum interrupter of horizontal magnetic field, there was provided a vacuum interrupter of vertical magnetic field form as U.S. Pat. No. 6,163,002 by the patentee of the present invention. In the vacuum interrupter of the above patent, three or four magnetic fields are formed using movable electrode and stationary electrode which form three or four electric current loops, and therefore the arc is not concentrated on the contact. However, it is effective in case that the arc is generated in the three or four vertical magnetic fields, but the only one or two arcs can be generated and these may be generated on boundary portion between the vertical magnetic fields. Therefore, it is difficult to deal with the one or two arcs which are concentrately generated with the three or four vertical magnetic fields, and the arc dispersion operation is not performed for the arc which is generated on the boundary between the vertical magnetic fields. Therefore, the problems of the conventional art such as a surface concretion on the contact can not be solved.

SUMMARY OF THE INVENTION

Therefore, an object of the present invention is to provide a vacuum interrupter for a vacuum circuit breaker by which an arc is rapidly extinguished and a melting phenomenon of a contact can be prevented when a large abnormal current is broken by forming one magnetic field affecting evenly to entire surface of the contact in vertical direction parallelly with the arc when an electrode is separated.

To achieve the object of the present invention, as embodied and broadly described herein, there is provided a vacuum interrupter for a vacuum circuit breaker comprising: a vacuum container which is sealed so as to be vacuum state therein; a stationary cylinder electrode fixed on upper part of the vacuum container so as to be sealed and connected to electric source; a stationary disc electrode, in which a plurality of slits extended from positions dividing an outer circumferential surface into three parts as predetermined angles towards positions eccentric as predetermined angles from center, connected to the stationary cylinder electrode mechanically and electrically inside the vacuum container, and a plurality of electric paths formed by the slits in order to form a vertical magnetic field are included.

In addition, there is provided a vacuum interrupter for a vacuum circuit breaker comprising: a stationary contact plate connected to the stationary disc electrode; a first shielding plate installed between the stationary disc electrode and the stationary contact plate in order to break the stationary disc electrode and the stationary contact plate electrically and magnetically; a plurality of first conductive pins installed on outer side of the shielding plate between the stationary disc electrode and the stationary contact plate in order to connect the stationary disc electrode and the stationary contact plate electrically; a movable contact plate installed so as to face the stationary contact plate and movable between positions of contacting to the stationary contact plate and separating from the stationary contact plate; a movable disc electrode connected to the movable contact plate electrically, wherein a plurality of slits extended from positions dividing the outer circumferential surface into three parts as predetermined angle toward the positions of eccentric from the center as predetermined angle are included, and a plurality of electric paths formed by the slits in order to form one vertical magnetic field by compounding a magnetic field formed by the stationary disc electrode and a magnetic field formed by a plurality of electric paths of electric current flowing to same direction as the electric current flowing on the electric path of the disc electrode are included; a second shielding plate installed between the movable disc electrode and the movable contact plate for shielding the stationary disc electrode and the stationary contact plate electrically and magnetically; a plurality of second conductive pins installed on outer side than the shielding plate between the movable disc electrode and the movable contact plate in order to connect the stationary disc electrode and the stationary contact plate electrically; and a movable cylinder electrode connected to the movable disc electrode electrically and mechanically, connected to electric load, and installed on lower part of the vacuum container so as to be sealed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments for a vacuum interrupter of vertical magnetic field according to the present invention, and the most preferred embodiments will be described.

Figure 1:
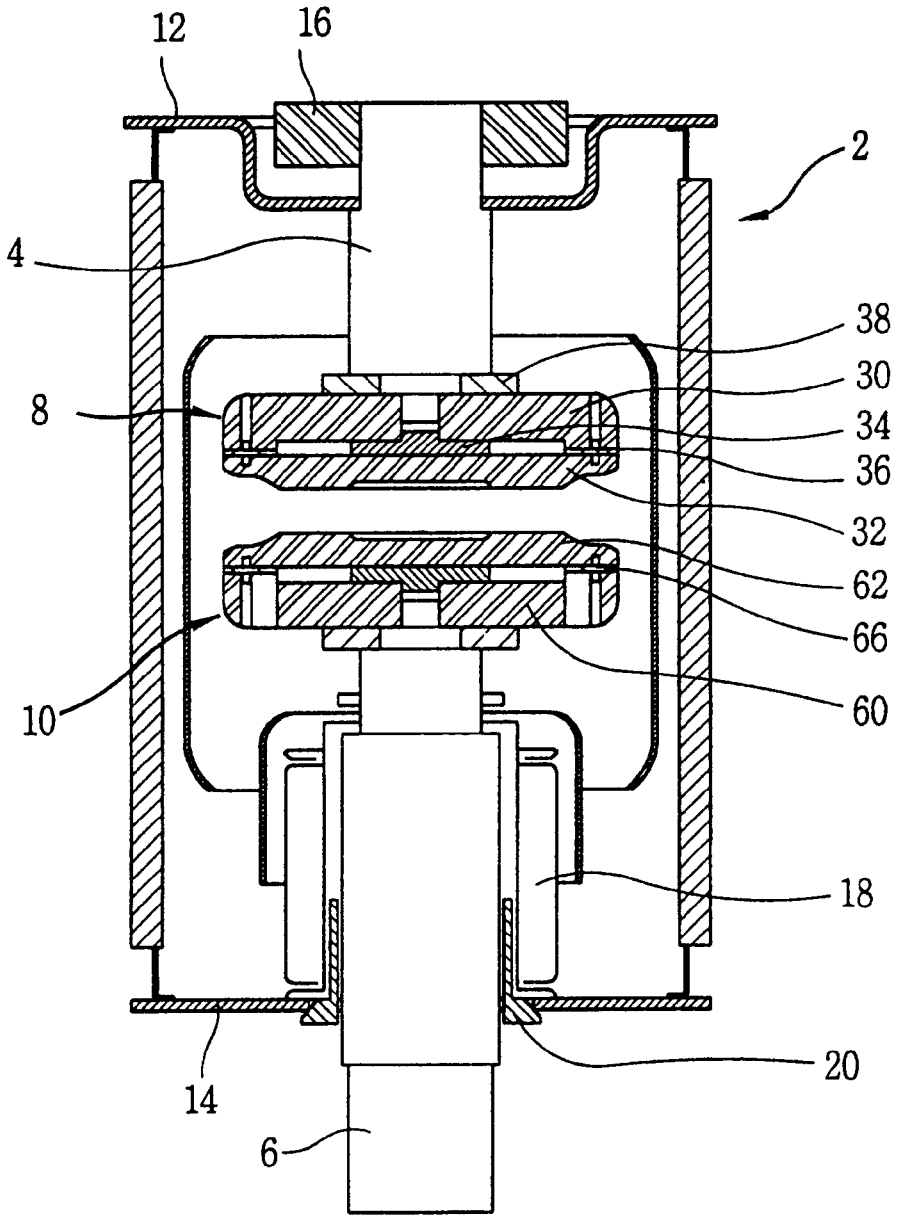
FIG. 1 is a longitudinal cross-sectional view showing a vacuum interrupter for a vacuum breaker according to the present invention.
Figure 2:
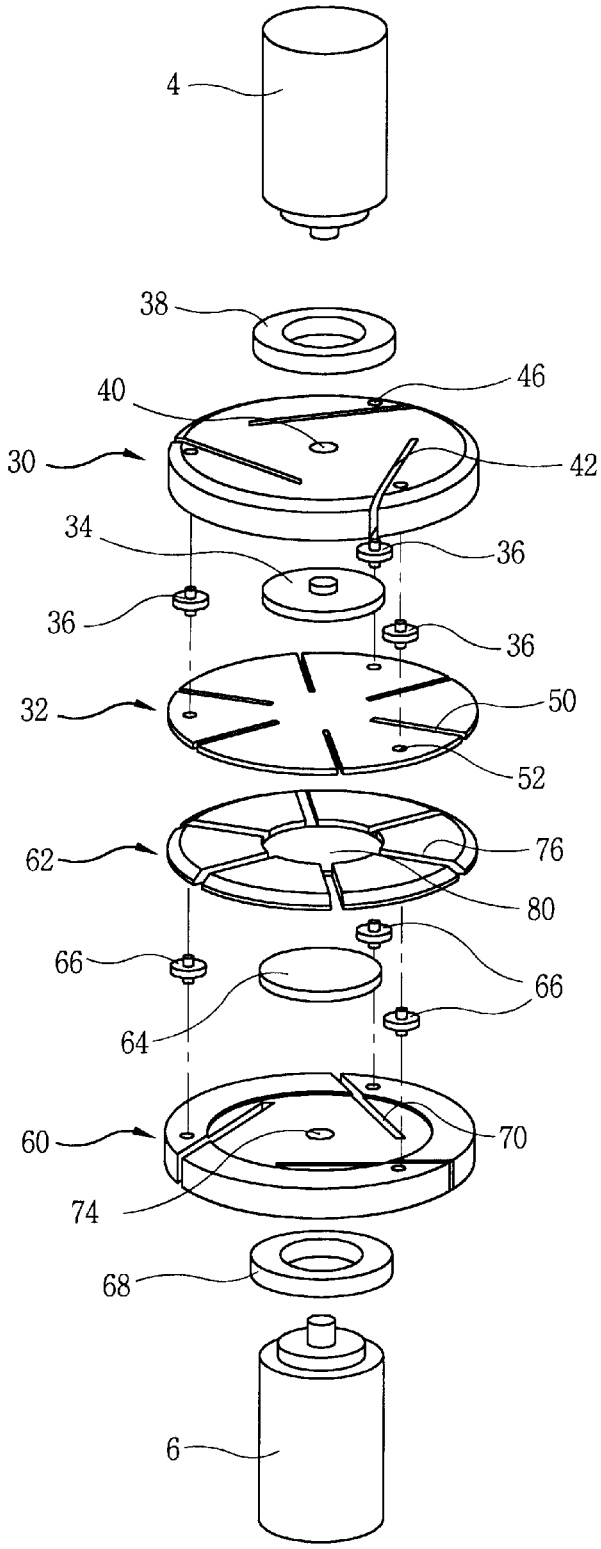
FIG. 2 is an exploded perspective view showing the vacuum interrupter for the vacuum breaker according to the present invention.
Figure 3:
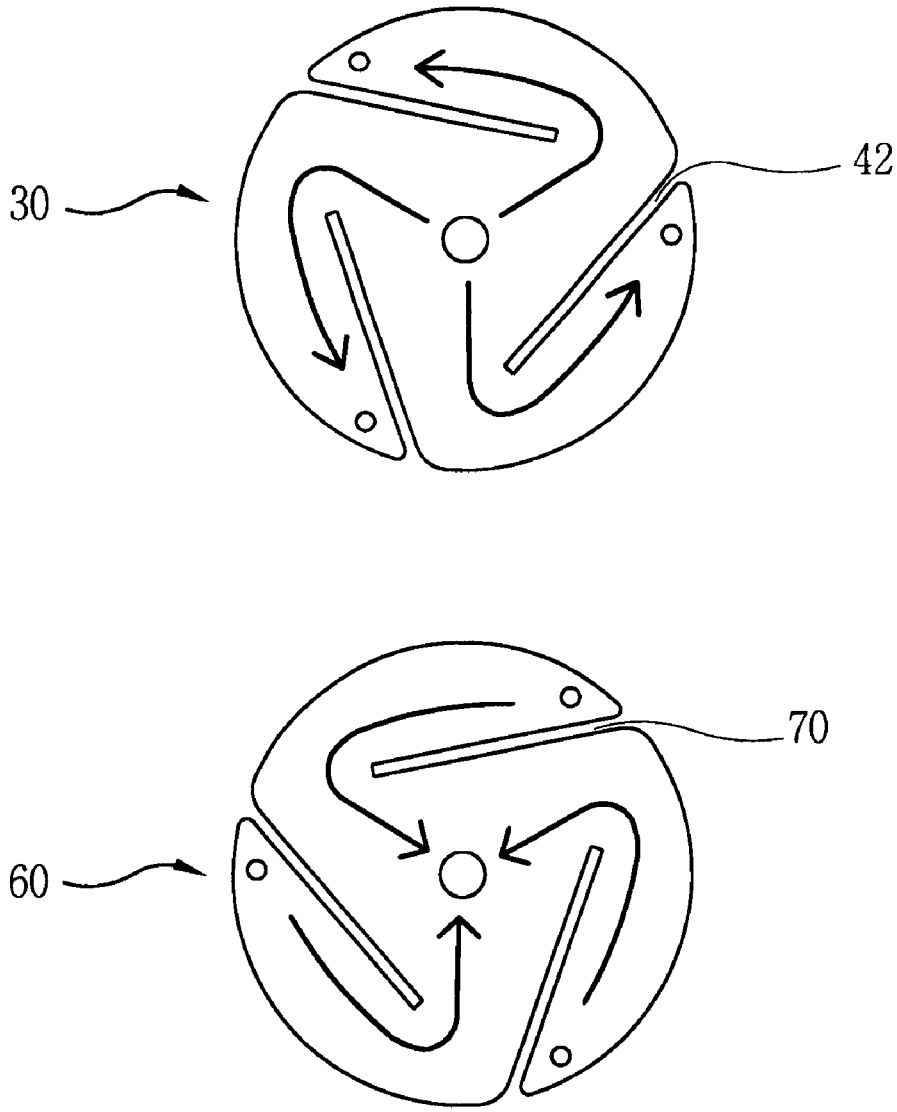
FIG. 3 is a front view of a disc electrode showing electric current flowing in the vacuum interrupter for the vacuum breaker according to the present invention.

FIG. 1 is a cross-sectional view showing the vacuum interrupter for a vacuum breaker according to the present invention, FIG. 2 is an exploded perspective view showing the vacuum interrupter for the vacuum breaker according to the present invention, and FIG. 3 is a front view showing a stationary and movable coil conductor in the vacuum interrupter according to the present invention.

The vacuum interrupter of vertical magnetic field according to the present invention comprises: a vacuum container 2; a stationary cylinder electrode 4 fixed on upper center of the vacuum container 2; a movable cylinder electrode 6 disposed on lower center of the vacuum container 2 so as to be movable to up and down; and a movable contact assembly 8 and a stationary contact assembly 10 respectively disposed on the stationary cylinder electrode 4 and on the movable cylinder electrode 6 for forming a vertical magnetic field which is parallel with arc electric current generated in vertical direction when contacts are separated during a large current is broken.

The vacuum container 2 is made by using an insulating material of cylinder shape. And the vacuum container 2 comprises a stationary part cover 12, on which the stationary cylinder electrode 4 is fixed, installed on upper part, and a movable part cover 14, on which the movable cylinder electrode 6 is disposed so as to be linearly moved, is installed on lower part.

The stationary cylinder electrode 4 is made using deoxidized copper which has high electric conductivity, and its one end is fixed on the stationary part cover 12 so as to be sealed. In addition, a stationary terminal 16 is installed on lower part of the stationary cylinder electrode 4, and a stationary contact assembly 8 is installed on lower part of the stationary cylinder electrode 4.

The movable cylinder electrode 4 is installed on the movable part cover 14 so as to be slid, and a bellows 18 is installed in circumferencial direction of the movable cylinder electrode 4 so as to maintain the sealed stated when the movable cylinder electrode 4 is moved to up and down, and a stationary contact assembly 10 is installed on upper end. In addition, a bushing 20 for sealing is inserted between the movable cylinder electrode 6 and the movable part cover 14.

The movable cylinder electrode 6 is movable vertically to upward and downward in accordance with operations of an outer mechanical actuator(not shown) when an abnormal current is generated.

FIG. 2 is an exploded perspective view showing the stationary contact assembly and the movable contact assembly according to the present invention.

The stationary contact assembly 8 comprises a stationary disc electrode 30 located on lower part of the stationary cylinder electrode 4 for inducing the current flowing to radial direction; a stationary contact plate 32 disposed on the stationary disc electrode 30 so as to face the stationary disc electrode 30; a shielding plate 34 installed between the stationary disc electrode 30 and the stationary contact plate 32 for shielding the flowing of the electric current between the stationary disc electrode 30 and the stationary contact plate 32; and a plurality of conductive pins 36 disposed on outer positions horizontally than the outer circumference of the shielding plate 34 with a predetermined angle(desirably, 120°) between the stationary disc electrode 30 and the stationary contact plate 32 in order to provide electric paths between the stationary disc electrode 30 and the stationary contact plate 32.

A supporting plate 38 for supporting the stationary disc electrode 30 is installed between the stationary disc electrode 30 and the stationary cylinder electrode 4.

The stationary disc electrode 30 includes a coupling hole 40 penetratingly formed on center portion in which a protruded end part of the stationary cylinder electrode 4 is inserted and coupled, and three slits 42 for dividing the electric current from the stationary cylinder electrode 4 into three parts and rotating as shown in FIG. 3. The respective slits 42 are formed as extended from an outer circumferential surface of the stationary disc electrode 30 toward the positions which is eccentric as 45° to the center of the stationary disc electrode 30. On end parts of the respective electric paths divided by the slits, pin holes 46 in which the conductive pins 36 are inserted are formed.

In case that the electric current is applied from the stationary cylinder electrode 4, the electric current is applied from the center part which is coupled to the protruded end part of the stationary cylinder electrode 4 and flows to outside. And one-third electric current flows on the respective electric paths divided by the slits, and is induced to the stationary contact plate 32 through the conductive pins 36.

At that time, the electric currents flowing on the respective electric paths of the three arc shapes on the stationary disc electrode 30 are rotated to same direction as each other and form one magnetic field in vertical direction.

The stationary contact plate 32 of circular plate includes six slits 50, which divide the stationary contact plate 32 into six parts from the center part to the radial direction, formed with 60° gap therebetween from the center part to the circumferential direction in order to reduce the friction when the stationary contact plate 32 is separated from the movable contact assembly 10, and a pin holes 52 formed on end parts of three electric paths among those six electric paths divided by the slits 50 for being inserted the conductive pin 36.

On the stationary contact plate 32 as described above, the electric current flows from outer side of the electric path on which the pin hole 52 is formed to the center part of the stationary contact plate 32 when the electric current is applied from the stationary disc electrode 30 through the conductive pin 36.

It is desirable that the shielding plate 34 is formed using stainless steel which is a non-magnetic material having high resistance in order to shield the flowing of the electric current except the electric path through the conductive pin 36 between the stationary disc electrode 30 and the stationary contact plate 32 and at the same time to prevent heat generation because of being induced the magnetic flux.

The movable contact assembly 10 comprises: a movable disc electrode 60 coupled to the movable cylinder electrode 6; a movable contact plate 62 disposed on one surface of the movable disc electrode 60 and movable to contact position or separating position with the stationary contact plate 32; a shielding plate 64 for shielding the electric current flowing between the movable contact plate 62 and the movable disc electrode 60; and three conductive pins 66 installed on outer positions horizontally than the outer circumference of the shielding plate 64 between the movable disc electrode 60 and the movable contact plate 62 for providing electric path from the movable contact plate 62 to the movable disc electrode 60. In addition, the movable disc electrode 60 is supported on the movable cylinder electrode 6 by the supporting plate 68.

The movable disc electrode 60 has a coupling hole 74 penetrating the center part so that the protruded end part of the movable cylinder electrode 6 is inserted therein and coupled to the movable cylinder electrode 6, and slits 70 for dividing the electric current transmitted from the stationary contact assembly 8 through the movable contact plate 62 and the conductive pin 66 into three parts and rotating to same directions as shown in lower view in FIG. 3.

The slits 70 are formed as extended from the respective positions which are dividing the outer circumferential surface of the movable disc electrode 60 into three parts to the positions which are eccentric as 45° from the radial center of the movable disc electrode 60 same as the slits 42 on the stationary disc electrode 30.

On the movable disc electrode as described above, in case that the electric current is applied through the conductive pin 76 from the movable contact plate 62, the electric current is applied from the outer circumferential part coupled to the conductive pin 76 and flows to the radial center. And then one-third electric current flows on the respective electric paths divided by the slits 70, and induced to the movable cylinder electrode through the protruded end part of the movable cylinder electrode 6.

At that time, the electric currents flowing on the respective electric paths of arc shape on the movable disc electrode 60 are rotated to same direction as each other and form a compounded magnetic field in vertical direction. Also, as shown in FIG. 3, the rotating direction of the electric current flowing on the electric path of the stationary disc electrode 30 and the rotating direction of the electric current flowing on the electric path of the movable disc electrode 60 are all to the counter-clockwise direction on the Figures. Therefore, the stationary disc electrode 30 and the movable disc electrode 60 form a strong vertical magnetic field.

In addition, the movable contact plate 62 includes six slits 76 which divides the electric path into six parts in circumferential direction in order to separate rapidly when the movable contact plate 62 is separated from the stationary contact plate 32 by reducing the friction. And the slits 76 are disposed on positions rotated from the slits 50 of the stationary contact plate 32 as 60°. That is, the contact surface of the stationary contact plate 32 on which the conductive pin 36 is installed and the contact surface of the movable contact plate 62 on which the conductive pin 66 is not installed are disposed so as to face each other, and contacted or separated.

A recess units 80 are formed on center part of the contact surfaces of the stationary contact plate 32 and of the movable contact plate 62 for dispersing the arc so as not to be concentrated on the center part of the contact plates.

The operation of the vacuum interrupter of vertical magnetic field for the vacuum breaker according to the present invention will be described as follows.

Figure 4:
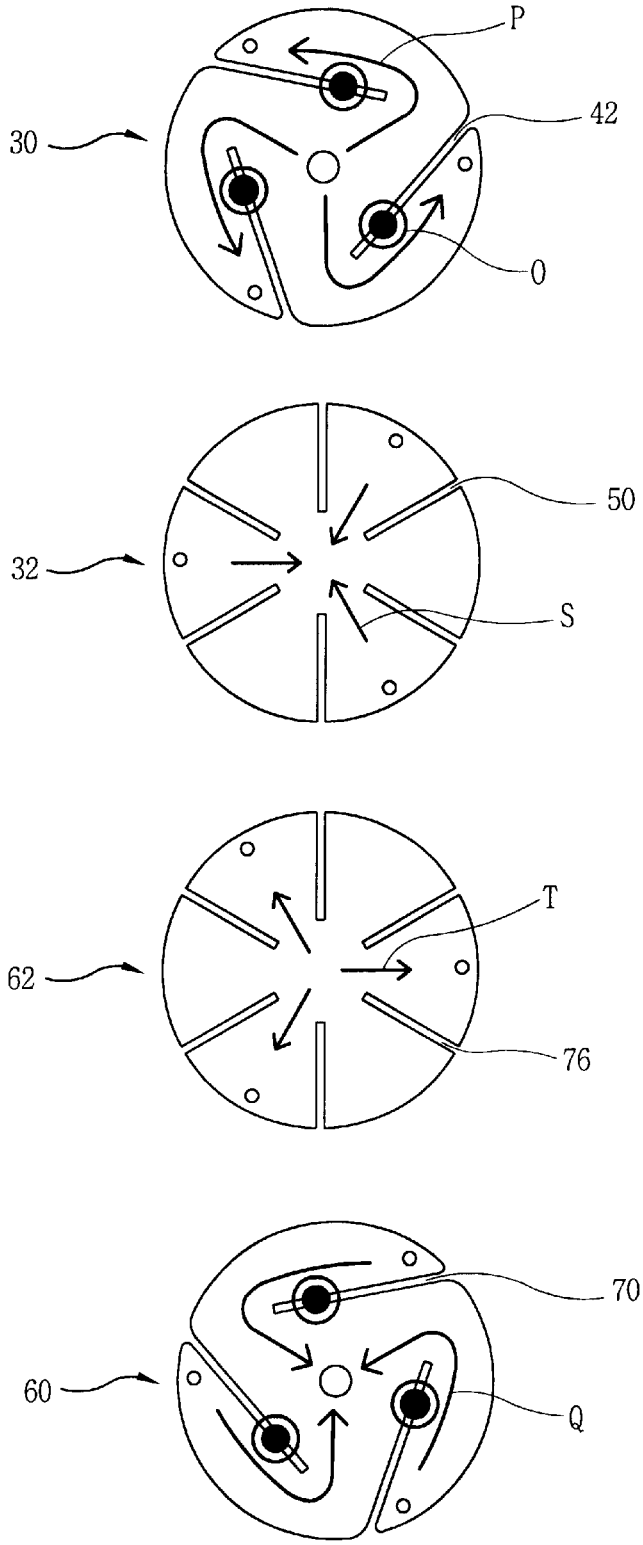
FIG. 4 is an operation status view showing direction of magnetic field in accordance with the flowing of the electric current in the vacuum interrupter of the present invention.

FIG. 4 is a status view showing an electric current flowing and forming direction of the magnetic field in the vacuum interrupter according to the present invention.

When a large current is generated and therefore the outer mechanical actuator(not shown) is operated, then the movable cylinder electrode 6 retreats, therefore the stationary contact plate 32 and the movable contact plate 62 are separated, and an arc is generated between them.

On the other hand, the electric current flows from the stationary cylinder electrode 4 to the stationary contact plate 32 and to the movable contact assembly 10 through the stationary disc electrode 30 and the conductive pin 36, and after that the electric current flows from the movable contact plate 62 passing the conductive pin 66 and the movable disc electrode 60 to the electric load (not shown) through the movable cylinder electrode 6.

In more detail, when the electric current is inputted through the stationary cylinder electrode 4, the electric current flows to the conductive pin 36 as flowing from the center part of the stationary disc electrode 30 to the outer radial direction as P direction in FIG. 4. At that time, the stationary disc electrode 30 is divided into three parts by the slits 42, and then has three electric paths. Therefore, one-third of the electric current flows on the respective conductive pins 36.

The electric current induced to the conductive pin 36 flows from outer side of the stationary contact plate 32 to the radial center, and flows to the movable contact plate 62 which is contacted to the stationary contact plate 32. And one-third of the current flows on the respective electric paths of the movable contact plate 62.

Herein, the recess portions 80 are formed on centers of contacted part in the stationary contact plate 32 and of the movable contact plate 62, and therefore the arc is not concentrated on the center and dispersed to radial outside when the arc is generated. Therefore, respectively lower arc current flows on the stationary contact plate 32 and on the movable contact plate 62.

The electric current induced to the movable contact plate 62 flows from the center part to the radial outside as T direction in Figure, and is applied to the movable disc electrode 60 through the conductive pin 64. Then, the electric current flows from outside of the three divisions of the movable part coil conductor 60 to the radial center as Q direction in Figure, and is outputted to the load through the movable cylinder electrode 6.

Herein, the electric currents which flow on the respective electric paths of arc shapes of the stationary disc electrode 30 are rotated to same directions as each other, and form one compounding magnetic field in vertical direction. Also, the electric currents which flow on the respective three electric paths of arc shape on the movable disc electrode 60 are rotated to same direction(counter-clockwise direction) as that of the current flowing on the electric paths of the stationary disc electrode 30, and form a compounding magnetic field in vertical direction strongly. On the other hand, the arc, which is generated between the stationary contact plate 32 and the movable contact plate 60 during breaking operation of the vacuum interrupter according to the large current generation, is generated in vertical direction. Therefore, when a strong magnetic field is applied in vertical direction to the arc, the arc is not concentrated on one position on the stationary contact plate 32 and on the movable contact plate 60, but dispersed evenly, and then extinguished.

Figure 5:
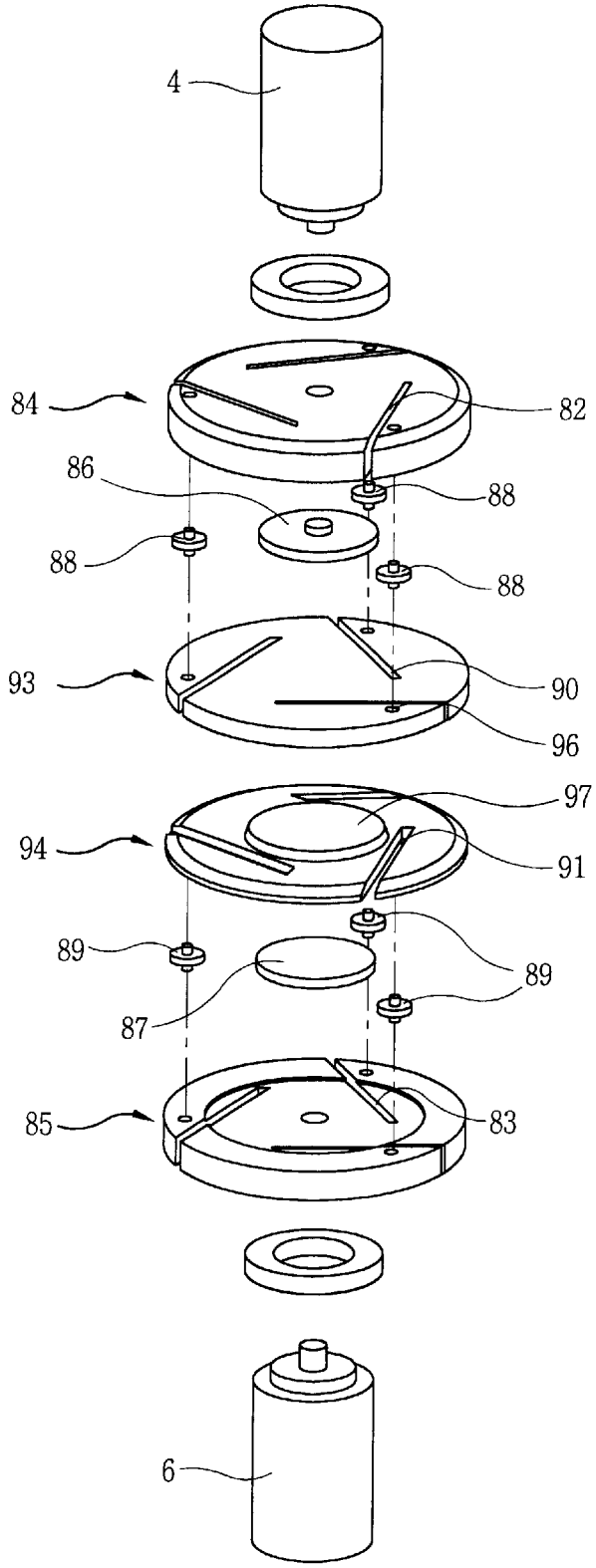
FIG. 5 is an exploded perspective view showing a vacuum interrupter according to a second embodiment of the present invention.
Figure 6:
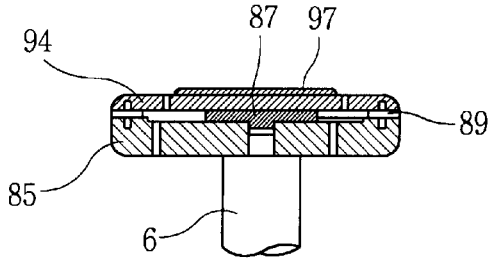
FIG. 6 is a cross-sectional view showing coupled state of the vacuum interrupter according to the second embodiment of the present invention.

FIG. 5 is an exploded perspective view showing a vacuum interrupter according to a second embodiment of the present invention, and FIG. 6 is a cross-sectional view showing coupled state of the vacuum interrupter according to the second embodiment of the present invention.

A contact assembly of the vacuum interrupter according to the second embodiment comprises: a stationary disc electrode 84 coupled to the stationary cylinder electrode 4 and dividing an electric path into three by forming three slits 82 in radial direction on circumferencial part; a movable disc electrode 85 coupled to the movable cylinder electrode 6 and dividing an electric path into three by forming three slits in radial direction on circumferencial part; a shielding plate 86 of disc form coupled to one surface of the stationary disc electrode 84 for shielding the stationary disc electrode 84 and a stationary contact plate 93 electrically and magnetically; a shielding plate 87 of disc form coupled to one surface of the movable disc electrode 85 for shielding the movable disc electrode 85 and a movable contact plate 94 electrically and magnetically; three conductive pins 88 connected on outer position than the outer circumference of the shielding plate 86 between the stationary disc electrode 84 and the stationary contact plate 93 with a predetermined gaps(120°) therebetween for providing electric path between the stationary disc electrode 84 and the stationary contact plate 93; three conductive pins 89 connected on outer position than the outer circumference of the shielding plate 87 between the movable disc electrode 85 and the movable contact plate 94 with a predetermined gaps(120°) therebetween for providing electric path between the movable disc electrode 85 and the movable contact plate 94; a stationary contact plate 93 of disc form having three slits 90 formed in radial direction and connected to the stationary disc electrode 84 electrically and mechanically through the conductive pins 88; and a movable contact plate 94 of disc form having three slits 91 formed in radial direction, and connected to the movable disc electrode 85 electrically and mechanically through the conductive pins 89.

Herein, the stationary disc electrode and the movable disc electrode 84 and 85 have same structures as those of the stationary disc electrode and the movable disc electrode 30 and 60 in the first embodiment, and descriptions for those are emitted.

The stationary contact plate 93 includes slits 90 extended from respective positions, which divide the outer circumferential surface of the stationary contact plate 93 into three parts of 120°, to positions which are eccentric from the center of the stationary contact plate 93 as 45°. In addition, pin holes 96 in which the conductive pins 88 are inserted are formed on end parts of the three electric paths divided by the slits 90.

In addition, the movable contact plate 94 includes slits 91 extended from respective positions, which divide the outer circumferential surface of the movable contact plate 94 into three parts of 120°, to positions which are eccentric from the center of the movable contact plate 94 as 45°.

A pair of contact surfaces 97 of the stationary contact plate 93 and the movable contact plate 94 which are facing each other are formed as protruded a certain height from the respective centers.

Figure 7:
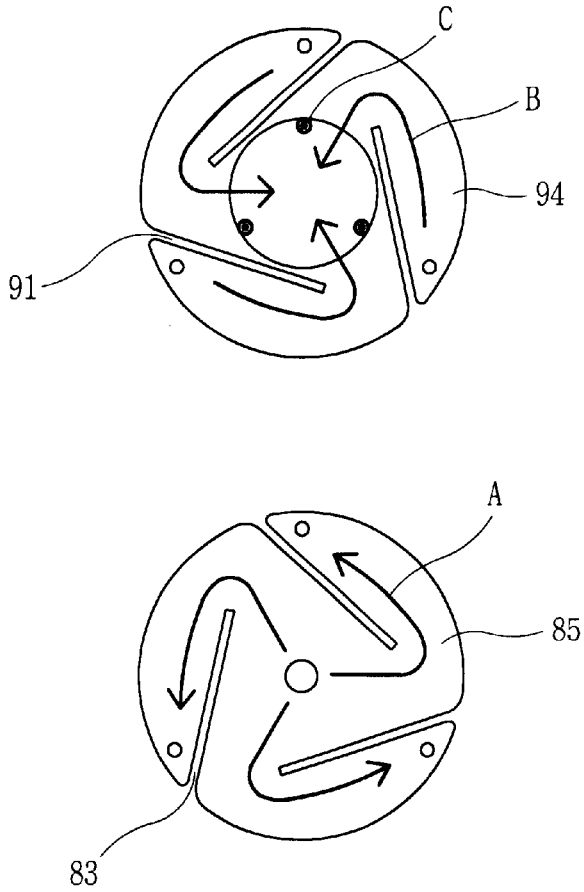
FIG. 7 is a view showing operating state of the vacuum interrupter according to the second embodiment of the present invention.

FIG. 7 is a view showing operating state of the vacuum interrupter according to the second embodiment of the present invention.

When the electric current is transmitted to the movable contact plate 94 from the stationary cylinder electrode 4 through the stationary disc electrode 84, the conductive pins 84, and the stationary contact plate 93, the electric current is rotated to clockwise direction through the three electric paths of arc shape divided by the slits 91 and flows from the contact surface 97 to the conductive pins 89.

After that, the electric current transmitted to the movable disc electrode 85 through the conductive pins 89 is rotated to clockwise direction through the electric paths divided by the slits 83 from the conductive pins 89, and flows to the center part of the movable disc electrode 85 in which the protruded end part of the movable cylinder electrode 6 is inserted and coupled.

At that time, the electric current flowing though the stationary disc electrode 84 and the stationary contact plate 93 is rotated to the clockwise direction, and therefore one strong magnetic field C is formed in vertical direction on the contact assembly. Therefore, according to the vacuum interrupter of the second embodiment, the stationary disc electrode 84, the stationary contact plate 93, the movable disc electrode 85, and the movable contact plate 94 all have electric paths rotating and flowing to same directions (clockwise direction) by three slits, and accordingly form a magnetic field in same direction(vertical direction). Therefore, the vertical magnetic field may be formed so as to have a strength as twice as that of the magnetic field in the first embodiment.

Therefore, dispersion and extinguishing of the arc generated between the stationary contact plate 93 and the movable contact plate 94 which are separated when the circuit is broken because of the large current can be made more rapidly than in the first embodiment.

Figure 8:
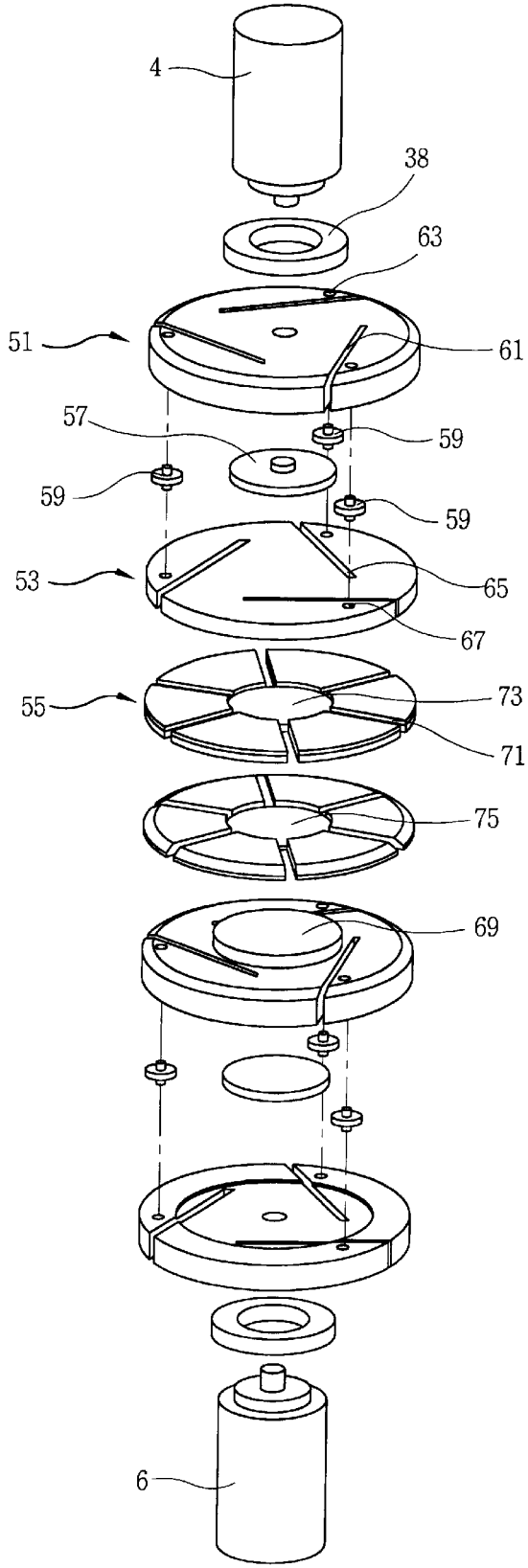
FIG. 8 is an exploded perspective view showing a vacuum interrupter according to a third embodiment of the present invention.
Figure 9:
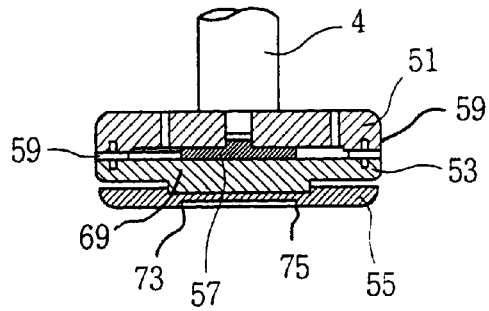
FIG. 9 is a cross-sectional view showing coupled state of the vacuum interrupter according to the third embodiment of the present invention.
Figure 10:
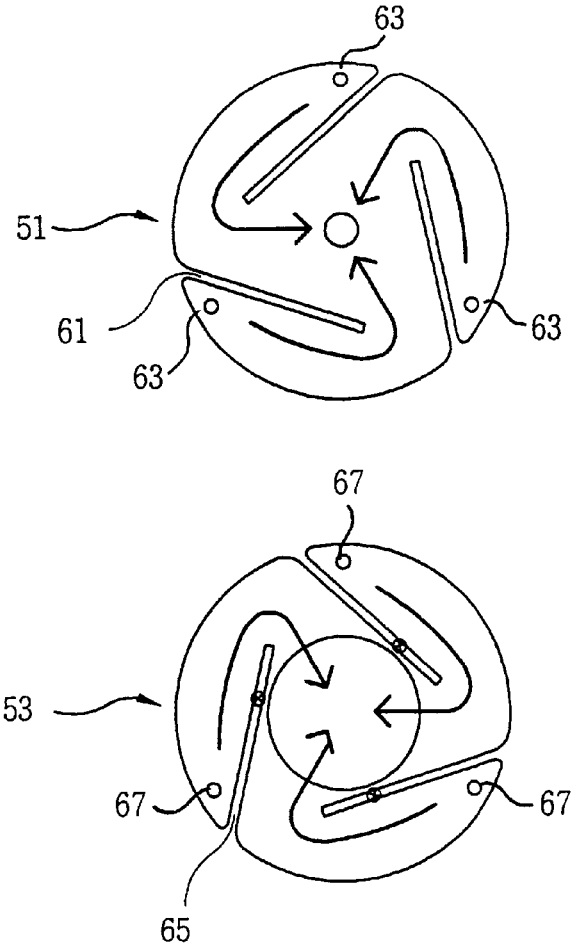
FIG. 10 is a view showing operating state of the vacuum interrupter according to the third embodiment of the present invention.

FIG. 8 is an exploded perspective view showing a movable contact assembly and a stationary contact assembly in a vacuum interrupter according to a third embodiment of the present invention, FIG. 9 is a cross-sectional view showing coupled state of the movable contact assembly and the stationary contact assembly in the vacuum interrupter according to the third embodiment of the present invention, and FIG. 10 is a view showing operating state of the vacuum interrupter according to the third embodiment of the present invention.

The stationary contact assembly and the movable contact assembly have same structure as each other, and therefore the stationary contact assembly between the two will be described as follows.

The stationary contact assembly comprises: a stationary cylinder electrode 4 connected to power source and having a protruded end part; a supporting plate 38 for supporting the stationary cylinder electrode 4 from lower position; a first stationary disc electrode 51 coupled to the stationary cylinder electrode 4 for inducing the electric current from the stationary cylinder electrode 4 to radial direction; a second stationary disc electrode 53 disposed on one surface of the first stationary disc electrode 51 so as to face to the first stationary disc electrode 51; a stationary contact plate 55 on one surface of the second stationary disc electrode 53 which is facing a movable contact plate; and a shielding plate 57 and a conductive pin 59 respectively disposed between the first stationary disc electrode 51 and the second stationary disc electrode 53.

The protruded end part of the stationary cylinder electrode 4 is inserted into a coupling hole which is formed on center part of the first stationary disc electrode 51. And the first stationary disc electrode 51 includes three slits 61 extended from respective positions, which divide the outer circumferential surface of the first stationary disc electrode 51 into three parts of 120°, to positions which are eccentric from the center of the first stationary disc electrode 51 as 45°, and pin holes 63, in which the conductive pins 59 are inserted, are formed on end parts of the three electric paths divided by the slits 61.

In addition, the second stationary disc electrode 53 includes three slits 65 extended from respective positions, which divide the outer circumferential surface of the second stationary disc electrode 53 into three parts of 120°, to positions which are eccentric from the center of the second stationary disc electrode 53 as 45°, and pin holes 67, in which the conductive pins 59 are inserted, are formed on end parts of the three electric paths divided by the slits 65. And a protruded part 69 for being inserted into an installing recess 73 of the stationary contact plate 55 and coupling the stationary contact plate 55 and the second stationary disc electrode 53 is formed on one surface facing to the movable contact assembly.

The stationary contact plate 55 includes six slits 71 in radial direction with a predetermined gap therebetween, a recess unit 73, in which the protruded part of the second stationary disc electrode 53 is inserted, formed on one surface facing the second stationary disc electrode 53, and a recess unit 75 for preventing the arc from concentrating on the center part formed on one surface facing the movable contact plate.

In the vacuum interrupter according to the third embodiment of the present invention as described above, the electric current is transmitted from the stationary cylinder electrode 4 to the movable contact plate through the first stationary disc electrode 51, the conductive pins 59, the second stationary disc electrode 53, and the stationary contact plate 55 when the contact point is contacted. As shown in FIG. 10, the electric current flowing on the first stationary disc electrode 51 is rotated to clockwise direction through the three electric paths of arc shape divided by the slits 61 and flows from the center part where the stationary cylinder electrode 4 is coupled to the conductive pins 59.

After that, the electric current transmitted to the second stationary disc electrode 53 through the conductive pins 59 is rotated to clockwise direction through the three electric paths of arc shape divided by the slits 65 and flows from the conductive pins 59 to the protruded part 69 which is inserted and coupled to the recess unit of the stationary contact plate 55.

Therefore, the first stationary disc electrode 51 and the second stationary disc electrode 53, in which the electric current flowing therethrough is rotated to the same direction (clockwise direction), form one compounded vertical magnetic field.

At that time, the electric currents which flow through the first movable disc electrode and the second movable disc electrode are also rotated to the clockwise direction. Therefore, one strong magnetic field in vertical direction is formed on the contact assembly.

In the vacuum interrupter described above, the first stationary disc electrode 51, the second stationary disc electrode 53, the first movable disc electrode, and the second movable disc electrode all have electric paths rotating and flowing to same directions(clockwise direction) by three slits, and accordingly form a magnetic field in same direction(vertical direction). Therefore, the vertical magnetic field may be formed so as to have a strength as twice as that of the magnetic field in the first embodiment.

Therefore, dispersion and extinguishing of the arc generated between the stationary contact plate 93 and the movable contact plate 94 which are separated when the circuit is broken because of the large current can be made more rapidly than in the first embodiment. Also, a concave recess for preventing the arc from concentrating on the center is formed on center part of the contact plate, and therefore the dispersion effects of the arc can be improved.

The vacuum interrupter for the vacuum breaker according to the present invention as described above includes electrodes which provides three electric paths of arc shape and induces the electric current to the same directions, and therefore a strong vertical magnetic field is formed. Therefore, when an arc is generated, the arc is rapidly dispersed on contact surface and rapidly extinguished.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum interrupter for a vacuum breaker comprising:

a vacuum container which is sealed so as to be vacuum state therein;

a stationary cylinder electrode fixed on upper part of the vacuum container so as to be sealed and connected to electric source;

a stationary disc electrode, in which a plurality of slits extended from positions dividing an outer circumferential surface into three parts as predetermined angles toward positions eccentric as predetermined angles from center, connected to the stationary cylinder electrode mechanically and electrically inside the vacuum container, and a plurality of electric paths formed by the slits in order to form a vertical magnetic field are included;

a stationary contact plate connected to the stationary disc electrode;

a first shielding plate installed between the stationary disc electrode and the stationary contact plate in order to break the stationary disc electrode and the stationary contact plate electrically and magnetically;

a plurality of first conductive pins installed on outer positions than the first shielding plate between the stationary disc electrode and the stationary contact plate in order to connect the stationary disc electrode and the stationary contact plate electrically;

a movable contact plate installed so as to face the stationary contact plate and movable between positions of contacting to the stationary contact plate and separating from the stationary contact plate;

a movable disc electrode connected to the movable contact plate electrically, wherein a plurality of slits extended from positions dividing the outer circumferential surface into three parts as predetermined angle toward the positions of eccentric from the center as predetermined angle are included, and a plurality of electric paths formed by the slits in order to form one vertical magnetic field by compounding a magnetic field formed by the stationary disc electrode and a magnetic field formed by a plurality of electric paths of electric current flowing to same direction as the electric current flowing on the electric path of the disc electrode are included;

a second shielding plate installed between the movable disc electrode and the movable contact plate for shielding the movable disc electrode and the movable contact plate electrically and magnetically;

a plurality of second conductive pins installed on outer positions than the shielding plate between the movable disc electrode and the movable contact plate in order to connect the movable disc electrode and the movable contact plate electrically;

a movable cylinder electrode connected to the movable disc electrode electrically and mechanically, connected to electric load, and installed on lower part of the vacuum container so as to be sealed;

a second stationary disc electrode which is installed between the stationary disc electrode and the stationary contact plate, and comprises a plurality of slits extended from positions which divide an outer circumferential surface as predetermined angle towards positions which are eccentric as predetermined angles from center part and a plurality of electric paths formed by the slits in order to form one vertical magnetic field compounded with the vertical magnetic field formed by the stationary disc electrode; and a second movable disc electrode which is installed between the movable disc electrode and the movable contact plate, and comprises a plurality of slits extended from positions which divide an outer circumferential surface as predetermined angle towards positions which are eccentric as predetermined angles from center part and a plurality of electric paths formed by the slits in order to form a vertical magnetic field which is additionally compounded with the compounded vertical magnetic field formed by the stationary disc electrode, the second stationary disc electrode, and by the movable disc electrode.

2. The vacuum interrupter of claim 1, wherein the stationary disc electrode comprises three slits extended from respective positions which are dividing an outer circumferential surface of the stationary disc electrode into three parts with 120° angles to positions which are eccentric as 45° angle from center of the stationary disc electrode in order to form three arc shaped electric paths, and the movable disc electrode comprises three slits extended from respective positions which are dividing an outer circumferential surface of the movable disc electrode into three parts with 120° angles to positions which are eccentric as 45° angle from center of the movable disc electrode in order to form three arc shaped electric paths so that the electric current flows to same direction as that of the current flowing on the electric paths of the stationary disc electrode.

3. The vacuum interrupter of claim 1, wherein each of the stationary contact plate and the movable contact plate includes recess portion for preventing arc from concentrating on center portion when the arc is generated.

4. The vacuum interrupter of claim 1, wherein the stationary contact plate and the movable contact plate respectively include a plurality of slits extended from outer circumferential surfaces to radial centers in order to reduce frictions so as to separate the contact rapidly.

5. The vacuum interrupter of claim 1, wherein the stationary contact plate comprises a plurality of slits extended from respective positions, which divide the outer circumferential surface of the stationary contact plate into three parts, to positions which are eccentric from the center of the stationary contact plate as predetermined angle in order to form a plurality of electric paths in which the electric current flows to same direction as that of the current which flows on the electric paths of the stationary disc electrode, and the movable contact plate comprises a plurality of slits extended from respective positions, which divide the outer circumferential surface of the movable contact plate into three parts, to positions which are eccentric from the center of the movable contact plate as predetermined angle in order to form a plurality of electric paths in which the electric current flows to same direction as that of the current which flows on the electric paths of the stationary contact plate.

6. The vacuum interrupter of claim 1, wherein the second stationary disc electrode and the second movable electrode include protruded portions for coupling respectively, and the stationary contact plate and the movable contact plate respectively include recess portions for coupling corresponding to the protruded portions.

* * * * *